United States Patent [19]

Stevens

[11] 3,935,965

[45] Feb. 3, 1976

[54] TOILET TISSUE DISPENSER

[75] Inventor: Robert B. Stevens, Greenwich, N.Y.

[73] Assignee: Stevens & Thompson Paper Company, Greenwich, N.Y.

[22] Filed: Apr. 26, 1974

[21] Appl. No.: 464,629

[52] U.S. Cl. ..... 221/48; 221/45

[51] Int. Cl.² ..... B65H 1/00

[58] Field of Search ..... 221/33, 45, 48–55, 221/61–63, 283, 34; 229/175; 312/60

[56] References Cited

UNITED STATES PATENTS

| | | | |
|---|---|---|---|
| 1,222,566 | 4/1917 | Sherman | 221/45 |
| 1,577,094 | 3/1926 | Arms | 221/48 |
| 2,101,307 | 12/1937 | Bodette | 221/62 |
| 2,426,787 | 9/1947 | O'Neil | 221/45 |
| 2,559,528 | 7/1951 | Barrett | 221/63 |
| 3,606,080 | 9/1971 | Lynch | 221/63 |
| 3,747,802 | 7/1973 | Uroshevich | 221/63 |

*Primary Examiner*—Robert B. Reeves
*Assistant Examiner*—H. Grant Shaggs
*Attorney, Agent, or Firm*—Andrus, Sceales, Starke & Sawall

[57] ABSTRACT

A toilet tissue dispenser for dispensing interfolded toilet tissue. The dispenser includes a casing having a narrow dispensing slot in the bottom surface. Connected to the slot is a finger hole or recess which extends forwardly of the slot and terminates in the front surface of the casing. The combination of the narrow slot and the finger hole provides easy starting of dispensing and prevents extraction of excessive quantities of tissue.

3 Claims, 4 Drawing Figures

Fig. 1
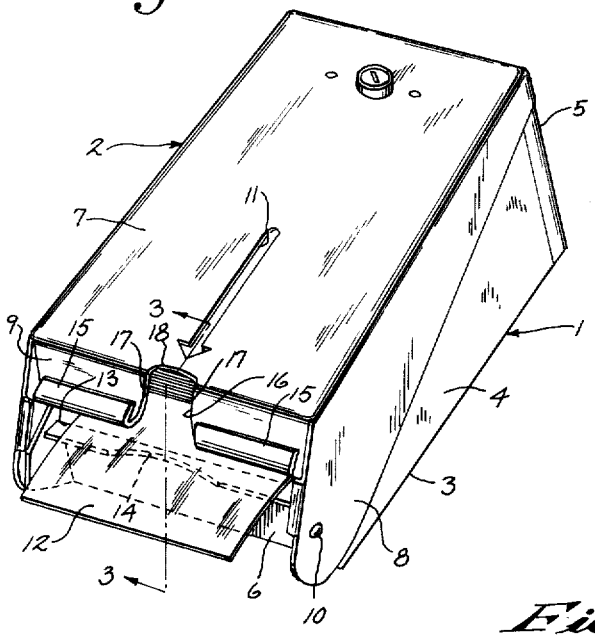
Fig. 3
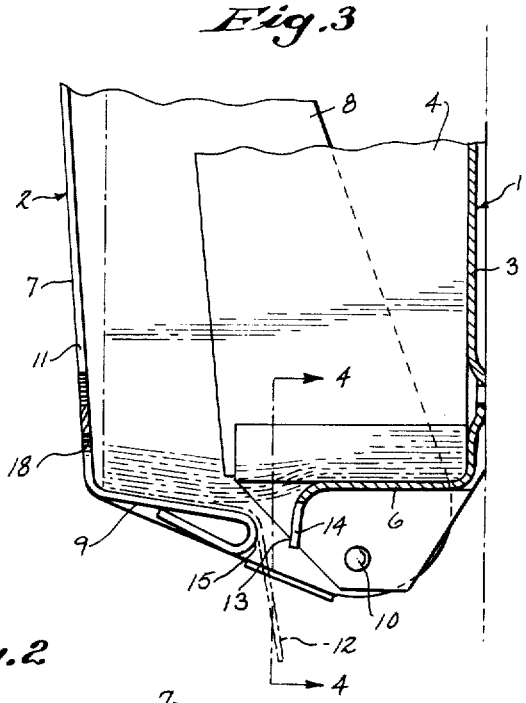
Fig. 2
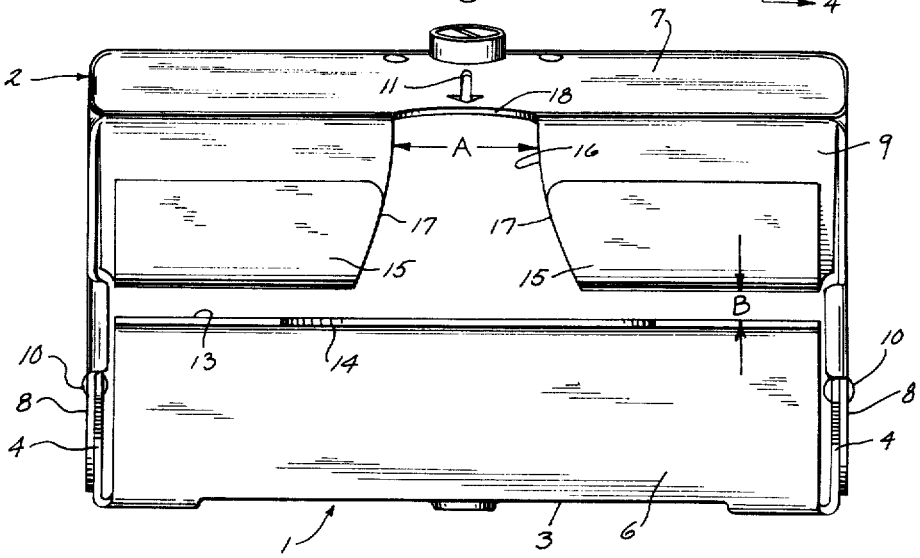
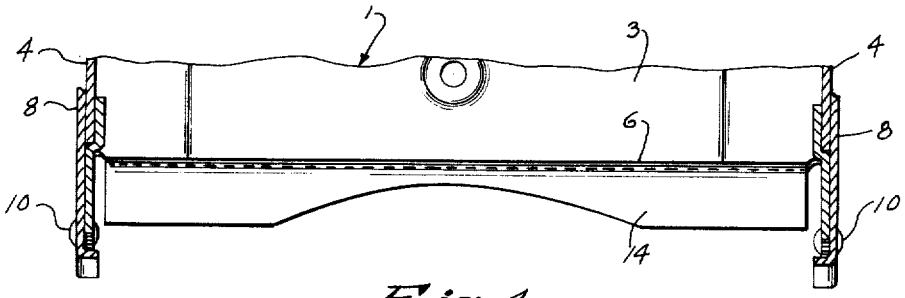
Fig. 4

TOILET TISSUE DISPENSER

BACKGROUND OF THE INVENTION

Interfolded toilet tissue is normally contained in a dispenser having a slot in its bottom surface for dispensing the tissue. With interfolded tissue, one end of each tissue is interfolded with the next tissue so that on removal of a tissue from the dispenser, the end of the next succeeding tissue will be drawn into the slot in position for subsequent removal. Occasionally the interfold between tissues is lost, with the result that it is neccesary for the user to insert a narrow instrument, such as a pencil or nail file, into the slot in an attempt to retrieve the tissue. Not only is it difficult to retrieve the tissue after the interfold is lost, but very often the tissues will be distorted or crushed so that they jam in the slot.

Increasing the width of the slot to enable the tissue to be more easily retrieved is not a solution, because the increased slot width will result in excessive quantities of tissue falling out of the dispenser when tissues at the end of the pack are being dispensed.

As a further problem, on replacement of a new pack of interfolded tissue in the dispenser, it is necessary for the attendant to interfold the starting tissue of the new pack with the trailing or last tissue of the old pack. It is difficult to interfold the tissues, and if they are not interfolded, no projecting end will be drawn out of the slot when the last tissue of the original pack is dispensed.

SUMMARY OF THE INVENTION

The invention relates to an improved toilet tissue dispenser which combines easy start up of dispensing while preventing extraction of excessive quantities of tissue. In accordance with the invention, the dispenser includes a casing having a narrow dispensing slot in the bottom surface. Communicating with the slot is a finger hole or recess which extends forwardly of the slot along the bottom surface and terminates in the front surface of the casing. The edges bordering the finger hole are curved so that the finger hole flares into the slot.

The combination of the narrow slot with the finger hole insures proper dispensing of the interfolded tissue without tearing the tissue and prevents extraction of excessive quantities of the tissue. This not only provides economies in the quantity of tissue used, but decreases clean-up time in the lavatory area.

As a further advantage it is not necessary to interfold the bottom tissue of a new pack with the top tissue of the old pack, for the user, after the old pack has been completely dispensed, can readily retrieve the next tissue.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the toilet tissue dispenser of the invention and showing the end of a tissue projecting from the dispenser slot;

FIG. 2 is a bottom view of the dispenser without the tissue being shown;

FIG. 3 is a section taken along line 3—3 of FIG. 2; and

FIG. 4 is a section taken along line 4—4 of FIG. 2.

DESCRIPTION OF THE ILLUSTRATED EMBODIMENT

The drawings illustrate a dispenser for dispensing interfolded toilet tissue with includes a housing 1, having an open front that is enclosed by a hinged cover 2.

The housing 1 includes a back surface 3, a pair of side surfaces 4, a top surface 5, and a bottom surface 6.

The cover 2, which encloses the open front of the housing 1, includes a front wall 7, a pair of side walls 8 which are joined to the side edges of the front wall and a bottom wall 9 which connects the side walls and front walls. The side walls 8 of the cover are hinged to the sides 4 of the housing at pivots 10, so that the cover 2 can be pivoted downwardly to provide for the insertion of new packs of interfolded tissue. The quantity of the toilet tissue within the dispenser can be viewed through a slot 11 in the front wall 7 of the cover.

The interfolded toilet tissues 12 are adapted to be dispensed from the dispenser through a narrow slot 13 located between the bottom wall 6 and the bottom wall 9. The edge of the bottom wall 6 is formed with a downwardly extending lip 14 which borders the slot, and the bottom wall 9 is formed with a pair of rolled or reversed edges 15 which also border the slot 13.

It has been found that the slot 13 should have a width of approximately 3/16 inch. If the width of the slot is appreciably less than this value the tissue will not dispense properly, while if the width of the slot is substantially greater than 3/16 inch, excessive quantities of tissue may fall through the slot when dispensing the last portion of the pack.

In accordance with the invention, the narrow dispensing slot 13 is combined with a finger opening or recess 16 which extends forwardly from the slot 13 along the bottom wall 9 and terminates in the front wall 7. As best shown in FIG. 2, the recess 16 is provided with curved side edges 17 which diverge outwardly in a rearward direction toward the slot, and the portion of the front wall 7 bordering the end of the slot is also curved as indicated by 18.

It has been found that the width of the recess 16 adjacent the forward edge of the bottom surface, as indicated by A in FIG. 2, should be approximately 3 to 5 times the width of the slot, as indicated by B.

The combination of the narrow dispensing slot 13 with the finger recess 16 provides a definite improvement in dispensing of the interfolded toilet tissue. The narrow slot prevents excessive quantities of the tissue from falling from the dispenser when the last few tissues of a pack are being dispensed. As the tissue is less likely to fall from the dispenser because of the narrow slot, less tissue will be wasted, and clean-up of the lavatory area will be facilitated.

The finger recess 16 combines with the slot 13 to enable a user to readily retrieve the tissue in the event a fold is lost. As the recess 16 extends upwardly within the forward surface 7, the position of the recess is readily apparent to the user. The invention eliminates the need for the attendant to manually interfold the bottom tissue of a new pack with the upper tissue of the old pack, so that the time required for substituting a new pack of tissue is substantially reduced.

As the finger opening is provided with curved diverging edges, as indicated by 17, there is less likelihood of tearing of the tissue under normal dispensing procedures and yet the flare or curvature is such that excessive tissues will not be drawn out of the slot during normal usage.

Various modes of carrying out the invention are contemplated as being within the scope of the following claims particularly pointing out and distinctly claiming the subject matter which is regarded as the invention.

I claim:

1. A dispenser for interfolded toilet tissue, a housing to contain the tissue and having a front surface, a bottom surface connected to the lower end of the front surface along a generally horizontal edge, and a pair of side surfaces connected to the side edges of the front surface and the bottom surface, said bottom surface having a slot extending in direction between said side surfaces and spaced rearwardly from said horizontal edge, said housing having a recess communicating with said slot and extending forwardly along the bottom surface to said horizontal edge and extending upwardly in said front surface, the portion of the recess in the bottom surface adjacent said horizontal edge having a substantially greater width than the width of said slot, the portion of the bottom surface disposed forwardly of the slot being located below the level of the portion of the bottom surface disposed to the rear of the slot, whereby the tissues supported on the bottom surface slop downwardly and forwardly, the edge of the bottom surface bordering the rear of the slot having a downwardly extending flange, and the edge of the bottom surface bordering the front of the slot being rounded and extending downwardly beneath the level of said flange, said interfolded tissue being dispensed by drawing the tissue downwardly from the slot and forwardly over the rounded edge of the bottom surface.

2. The dispenser of claim 1, wherein the slot has a width of approximately 3/16th inch.

3. The dispenser of claim 1, wherein the edges of the recess converge in a direction from said slot towards said horizontal edge.

* * * * *

UNITED STATES PATENT AND TRADEMARK OFFICE

CERTIFICATE OF CORRECTION

PATENT NO. : 3,935,965

DATED : February 3, 1976.

INVENTOR(S) : ROBERT B. STEVENS

It is certified that error appears in the above-identified patent and that said Letters Patent are hereby corrected as shown below:

Column 1, line 13, Cancel "neccesary" and substitute therefor ---necessary, Column 3, line 14 (Claim 1), After "in" insert ---a---, Column 4, Line 6, (Claim 1) Cancel "slop" and substitute therefor ---slope---.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*